US006419524B1

(12) United States Patent
Ma

(10) Patent No.: US 6,419,524 B1
(45) Date of Patent: Jul. 16, 2002

(54) ELECTRICAL CONNECTOR FOR FLEXIBLE PRINTED CIRCUIT

(75) Inventor: Hao-Yun Ma, Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/953,019

(22) Filed: Sep. 14, 2001

(30) Foreign Application Priority Data

Jul. 4, 2001 (TW) ..... 90211198 U

(51) Int. Cl.[7] ..... H01R 13/648
(52) U.S. Cl. ..... 439/607; 439/260; 439/499
(58) Field of Search ..... 439/607, 260, 439/267, 492, 495, 499, 497

(56) References Cited

U.S. PATENT DOCUMENTS 5,141,445 A * 8/1992 Little ..... 439/607
6,165,008 A * 12/2000 Wu et al. ..... 439/492
6,183,281 B1 * 2/2001 Wu et al. ..... 439/260
6,238,227 B1 * 5/2001 Wu et al. ..... 439/260

* cited by examiner

*Primary Examiner*—Hien Vu
(74) *Attorney, Agent, or Firm*—Wei Te Chung

(57) ABSTRACT

An electrical connector (10) for a flexible printed circuit (5) comprises an insulative housing (1), a plurality of terminals (2) received in the housing, a stuffer (4), and a shield (3) enclosing the housing. The housing comprises a receiving slot (13) for receiving the flexible printed circuit. The shield comprises a top wall (31), a bottom wall (32) opposite to the top wall, a pressing plate (34) positioned between and parallel to the top and bottom walls, and at least one linker (33). The pressing plate and bottom wall define a receiving slot for receiving the stuffer. The linker comprises a link plate (332) connecting the pressing plate and the bottom wall, and a block plate (334) extending laterally from a side edge of the link plate for supporting the stuffer and for preventing the stuffer from swaying when the stuffer is pulled out from the housing.

4 Claims, 5 Drawing Sheets

ELECTRICAL CONNECTOR FOR FLEXIBLE PRINTED CIRCUIT

BACKGROUND OF THE INVENTION

1. Field of the Invention

The present invention relates to an electrical connector, and particularly to an electrical connector which electrically connects a flexible printed circuit (FPC) with a complementary connector.

2. Description of Related Art

Taiwan Pat. Application Nos. 84218005, 85210257 and 88220830 each disclose a conventional electrical connector for a flexible printed circuit. Referring to FIG. 5, an earlier developed electrical connector, owned by the same assignee with the instant invention, for a flexible printed circuit comprises an insulative housing 6, a shield 7 enclosing the insulative housing 6, and a stuffer 8. The shield 7 includes a top wall 71, a bottom wall 72 opposite to the top wall 71, and a pressing plate 74 which is positioned between and parallel to the walls 71, 72. The pressing plate 74 is connected with the bottom wall 72 via a pair of rectangular linkers 73. The pressing plate 74 and top wall 71 define a first receiving slot 63 for receiving a flexible printed circuit (not shown). Similarly, the pressing plate 74 and the bottom wall 72 define a second receiving slot 64 for receiving the stuffer 8. The stuffer 8 comprises an elongate flange 82 and a pair of cutouts 83 for receiving the linkers 73. In manipulation, the flexible printed circuit is first inserted into the first receiving slot 63. Subsequently, the stuffer 8 is further pressed forward into the second receiving slot 64 to press the pressing plate 74 upwardly via the flange 82 thereof, whereby the pressing plate 74 upwardly presses the inserted flexible printed circuit into electrical connection with terminals (not shown) of the electrical connector.

However, as shown in FIG. 5, after the stuffer 8 is rearwardly pulled out to disengage the inserted flexible printed circuit from the terminals, the stuffer 8 is loosely received in the second receiving slot 64 and may sway upwardly and downwardly. Such a sway is not only inconvenient for manipulation, which may cause damage or breakage of the stuffer 8, but also inconvenient for packaging of the electrical connector.

Hence, an improved electrical connector for a flexible printed circuit is required to overcome the disadvantages of the conventional electrical connector.

SUMMARY OF THE INVENTION

Accordingly, one object of the present invention is to provide an electrical connector for a flexible printed circuit, which can prevent a stuffer thereof from swaying upwardly and downwardly.

In order to achieve the object set forth, an electrical connector for a flexible printed circuit in accordance with the present invention comprises an insulative housing, a plurality of terminals, a stuffer and a shield. The housing comprises a receiving slot for receiving the flexible printed circuit and a plurality of receiving passageways communicating with the receiving slot for receiving the terminals. The stuffer comprises an elongate body and an flange extending downwardly from a rear edge of the body. The body defines a pair of cutouts at the rear edge thereof. The shield enclosing the housing comprises a top wall, a bottom wall opposite to the top wall, a pressing plate positioned between and parallel to the top and bottom walls, and a pair of linkers for being received in the cutouts of the stuffer. The pressing plate and the top wall define a first receiving slot for receiving the flexible printed circuit. Similarly, the pressing plate and the bottom wall define a second receiving slot for receiving the stuffer. Each linker comprise a rectangular link plate connecting the pressing plate and the bottom wall, and a block plate extending laterally from a side edge of the link plate for supporting the body of the stuffer and for preventing the stuffer from swaying after the stuffer is pulled out from the housing.

Other objects, advantages and novel features of the invention will become more apparent from the following detailed description when taken in conjunction with the accompanying drawings.

DETAILED DESCRIPTION OF THE INVENTION

Figure 1:
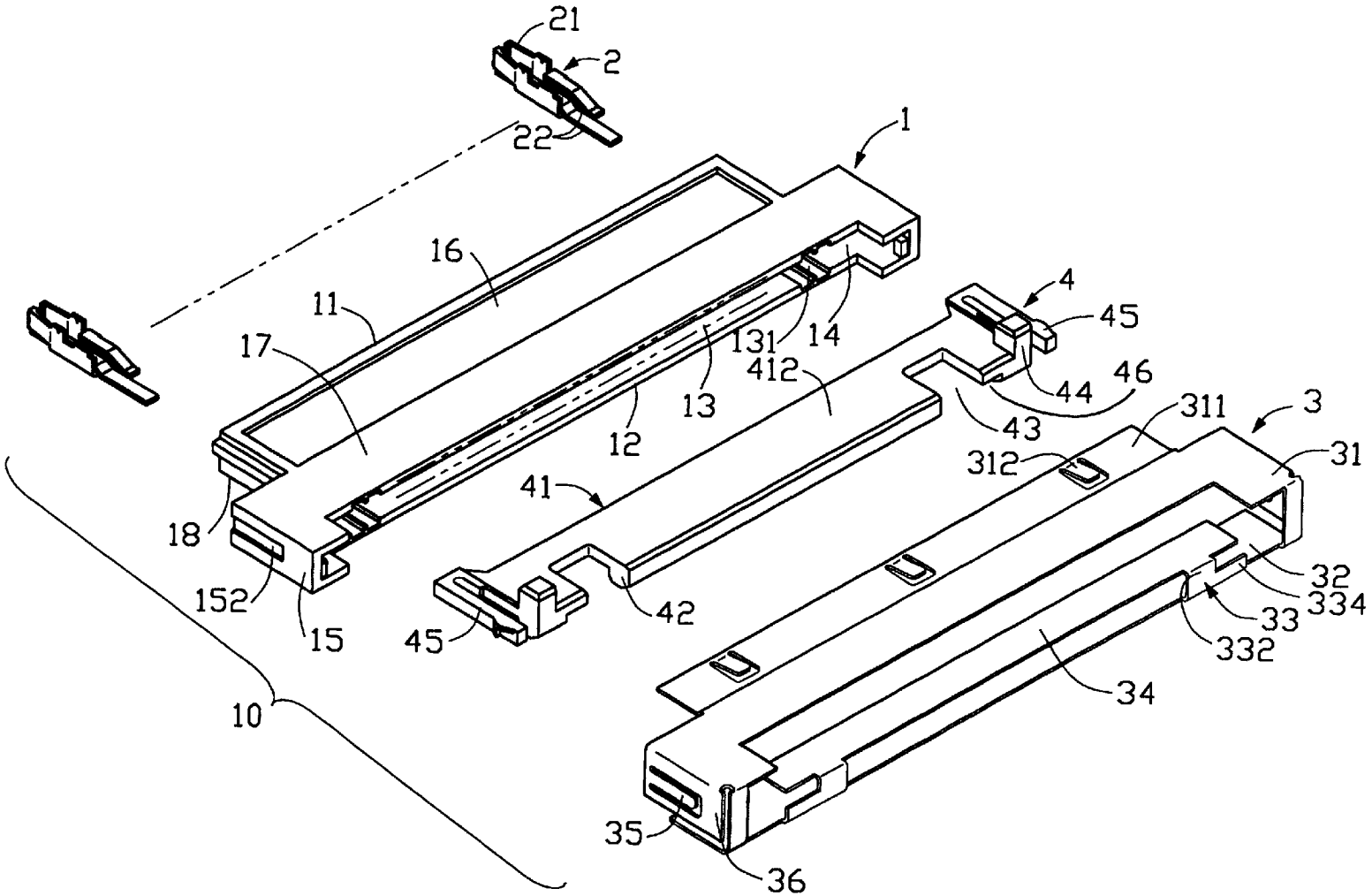
FIG. 1 is an exploded, perspective view of an electrical connector for a flexible printed circuit in accordance with the present invention.
Figure 2:
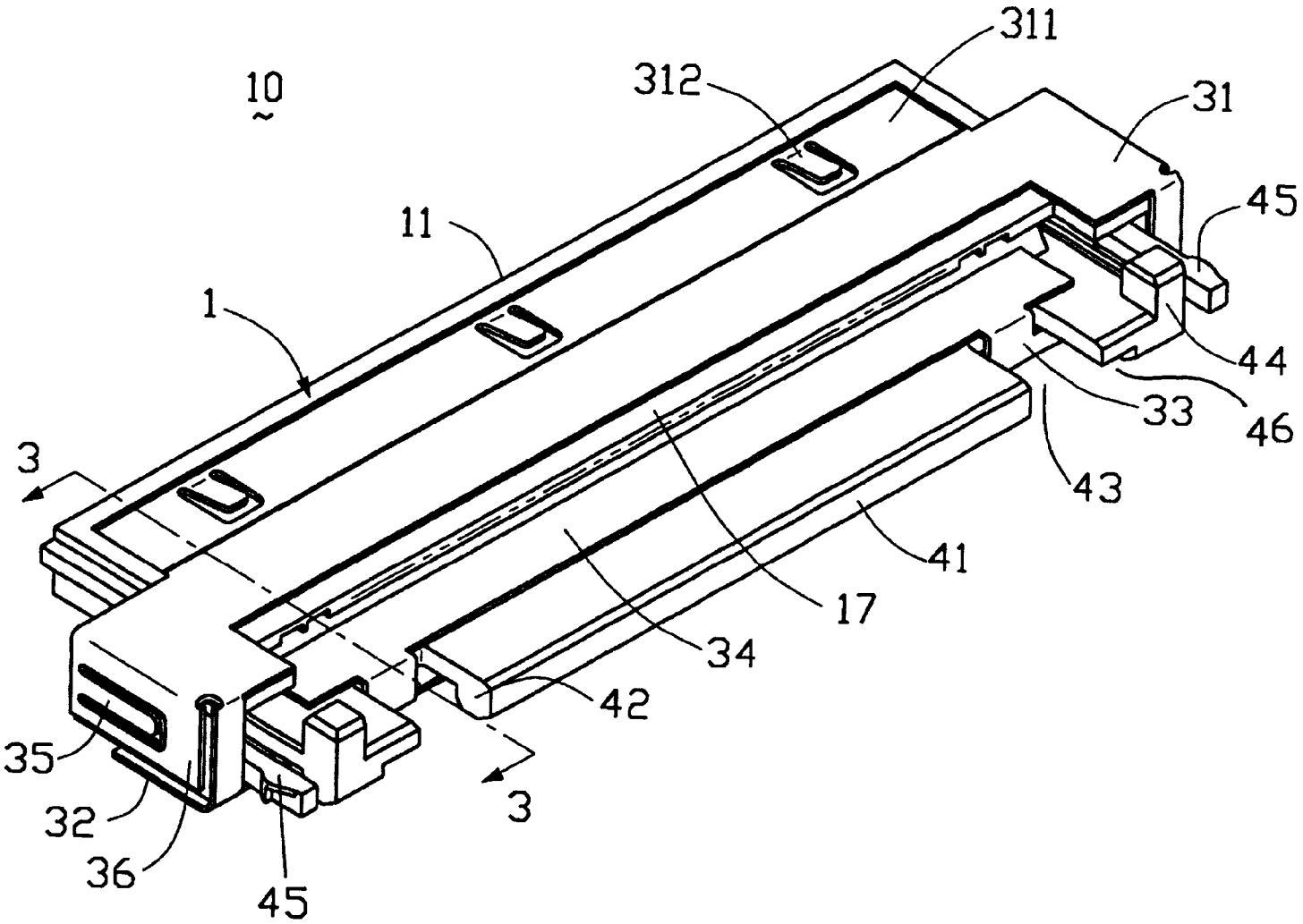
FIG. 2 is an assembled, perspective view of the electrical connector of FIG. 1 with a stuffer in a ready-to-engage position.

Reference will now be made to the drawing figures to describe the present invention in detail.

Referring to FIG. 1, an electrical connector 10 for a flexible printed circuit 5 (FIG. 3) of the present invention comprises an insulative housing 1, a plurality of terminals 2 for being received in the insulative housing 1, a shield 3 for enclosing the insulative housing 1 and a stuffer 4.

The insulative housing 1 comprises a front mating face 11 adapted for facing a complementary connector (not shown), a rear mating face 12 opposite to the front mating face 11, a top wall 17, a bottom wall 18 opposite to the top wall 17, and a pair of side walls 15 interconnecting the top and bottom walls 17, 18. The top wall 17 comprises a concave 16 near the front face 11. The top, bottom and side walls 17, 18, 15 define an elongate receiving slot 13 for receiving the flexible printed circuit 5. The top and bottom walls 17, 18 define a plurality of receiving passageways 131 communicating with the receiving slot 13 for receiving corresponding terminals 2. Each side wall 15 defines a guiding groove 14 communicating with the receiving slot 13. In addition, the housing 1 comprises a concave 152 on each side wall 15.

Each terminal 2 comprises a contacting portion 21 for mating with a corresponding mating contact of the complementary connector (not shown) and a tail portion 22 for electrically mating with the flexible printed circuit 5.

Figure 3:
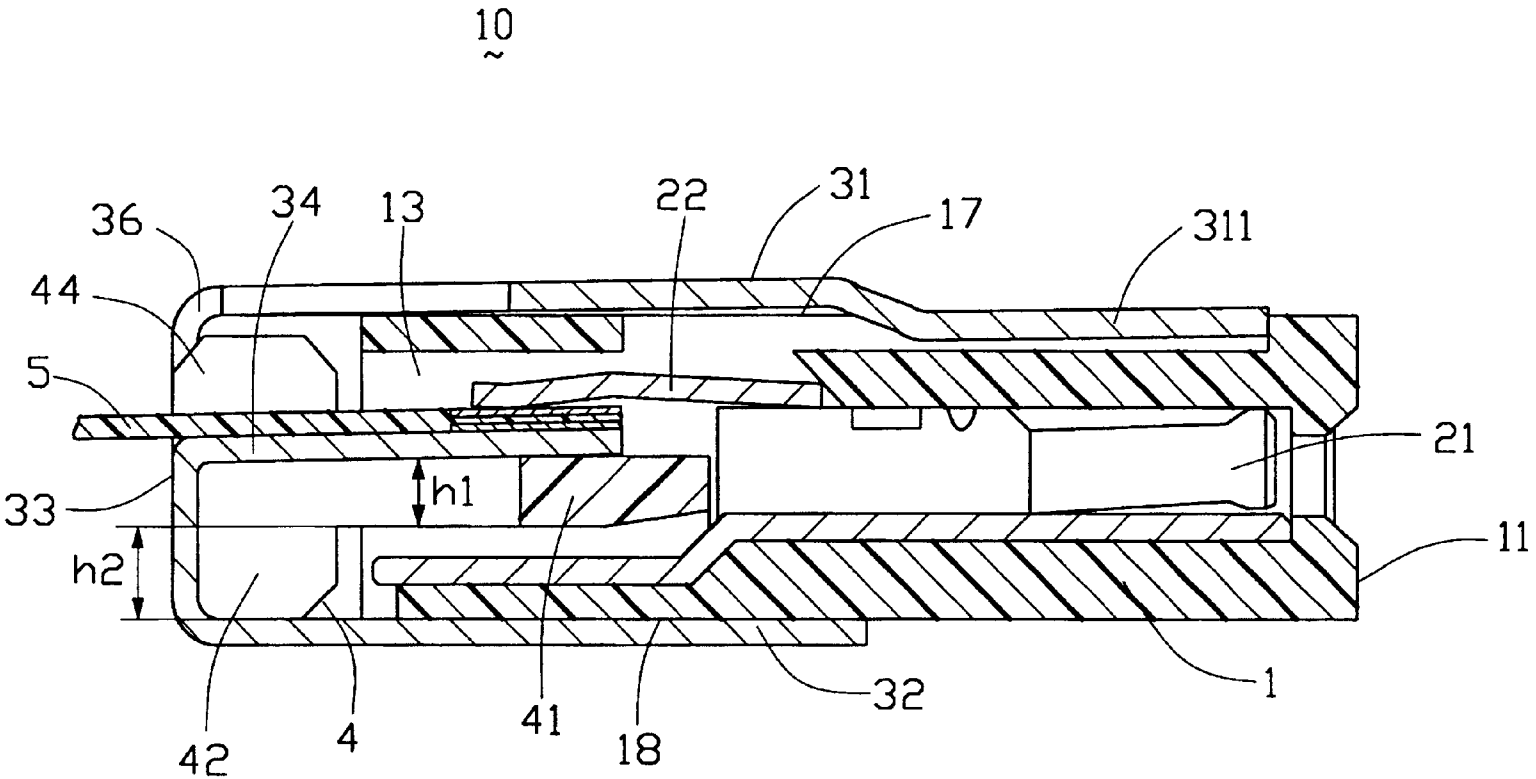
FIG. 3 is a cross-sectional view taken along line 3—3 of FIG. 2, with a flexible printed circuit inserted therein and the stuffer is fully assembled thereto.
Figure 4:
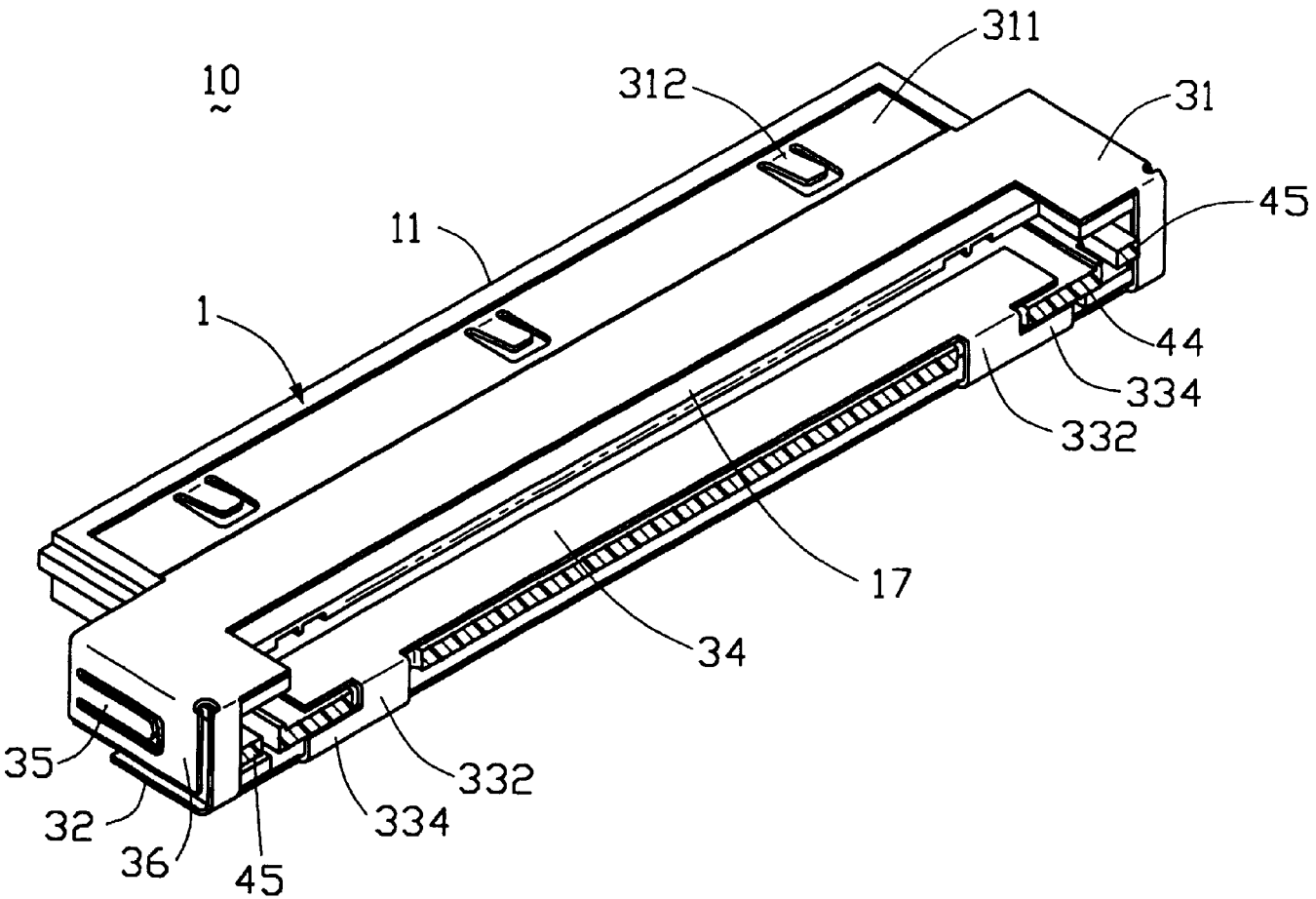
FIG. 4 is a cross-sectional view of FIG. 2.
Figure 5:
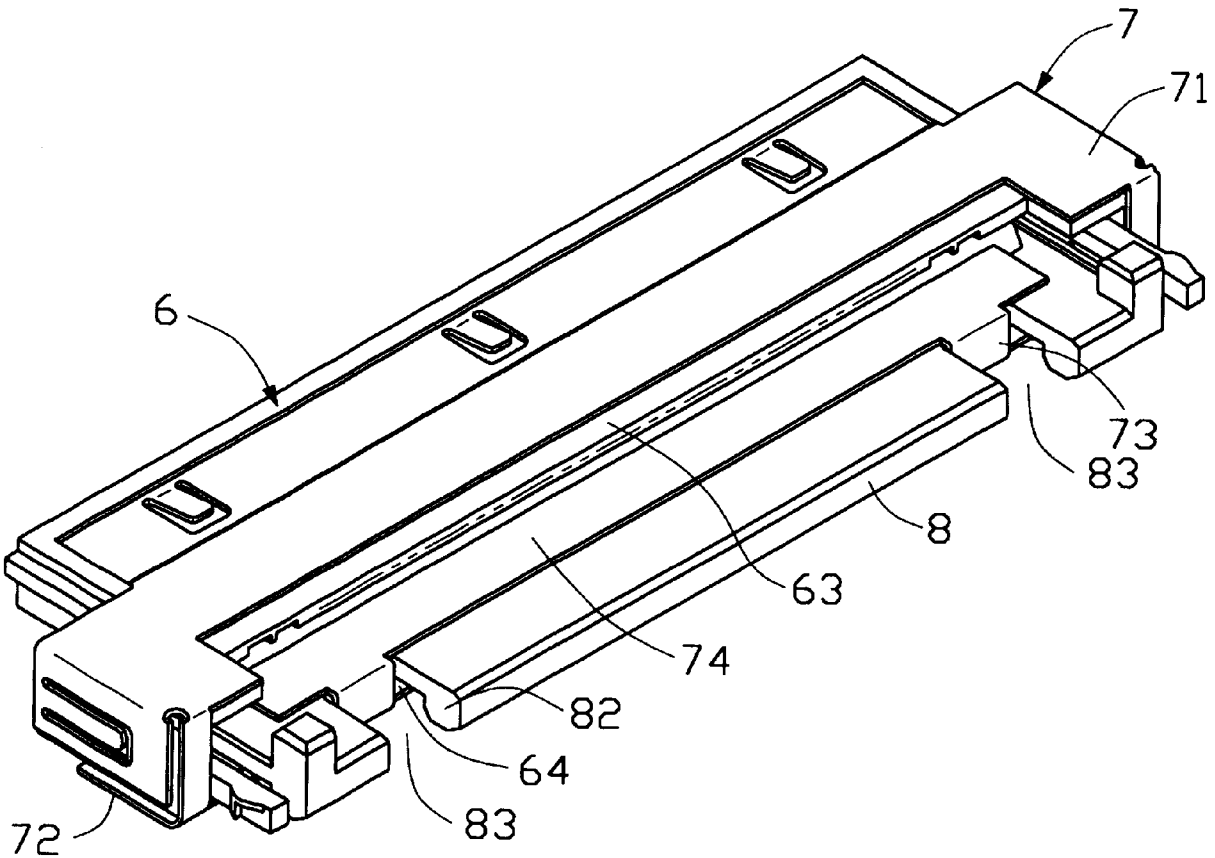
FIG. 5 (PRIOR ART)
FIG. 5 is a perspective view of an earlier developed and commonly owned electrical connector for a flexible printed circuit.

Referring to FIG. 1 and FIG. 3, the stuffer 4 comprises an elongate body 41 with a height $h_1$ and a pair of spring latch arms 45 at opposite ends of the body 41. The body 41 comprises a pair of opposite cutouts 43 in a rear end thereof. A pair of blocks 44 is formed on opposite ends adjacent to the latch arms 45 to prevent the stuffer 4 from being inserted into the slot 13 unduly. In addition, the body 41 comprises an elongate flange 42 with a height $h_2$ downwardly projecting from the rear edge thereof except a pair of spaces 46 remain therein.

Referring to FIG. 1, the shield 3 comprises a top wall 31, a bottom wall 32, and a pair of opposite side walls 36 for cooperatively defining a space therebetween to accommodate the housing 1, thereby shielding the housing 1 from EMI. The top wall 31 comprises an elongate fixing plate 311 at a front end thereof for covering the concave 16 of the housing 1. The fixing plate 311 comprises a plurality of lances 312 for engaging with a corresponding grounding part of the complementary connector. Each side wall 36 comprises a spring finger 35 stamped therein for engaging with a corresponding concave 152 of the housing 1. In addition, an elongate pressing plate 34 is positioned between and parallel to the top and bottom walls 31, 32, and is connected with a rear edge of the bottom wall 32 via a pair of linkers 33. Each linker 33 comprises a rectangular link plate 332 and a block plate 334 extending perpendicularly and laterally from a bottom of the link plate 332 to an adjacent side wall 36 of the shield 3. It should be noted that the link plate 332 has a width substantially equal to that of the cutout 43 and the block plate 334 has a height substantially equal to that of the flange 42.

In assembly, referring to FIGS. 1–4, the terminals 2 are positioned in the receiving passageways 131 from the mating face 12 of the housing 1. The stuffer 4 is inserted into the receiving slot 13 with the spring latch arms 45 thereof received in corresponding guiding grooves 14 of the housing 1. Subsequently, the housing 1 is placed in the shield 3, whereby the top wall 31, bottom wall 32 and side walls 36 of the shield 3 encloses the housing 1. The fixing plate 311 is received in the concave 16 of the housing 1 and the spring fingers 35 are received in corresponding concaves 152 of the housing 1. The pressing plate 34 of the shield 3 encloses an upper face 412 of the stuffer 4 and the link plate 332 of the linker 33 is received in the cutout 43.

In manipulation, the stuffer 4 is pressed into a lower half of the receiving slot 13 between the pressing plate 34 and the bottom wall 18 of the housing 1 with the blocks 44 thereof contacting the mating face 12 of the housing 1 and the block plates 334 engageably received within the spaces 46. The flange 42 of the stuffer 4 presses against the bottom wall 32 of the shield 3 and causes the pressing plate 34 to move upwardly to bring the inserted flexible printed circuit 5 into electrical connection with the tail portions 22 of the terminals 2. Because the distance between the pressing plate 34 and the bottom wall 32 is $h_1+h_2$ and the height of the block plate 334 is $h_2$, the distance between the block plate 334 and the pressing plate 34 is $h_1$ which is equal to the height of the body 41 of the stuffer 4. Therefore, the body 41 is properly positioned between the pressing plate 34 and the block plate 334, thereby solving the problem of upward and downward swaying occurred during and/or after the stuffer 4 is pulled out from the housing 1 and the pressing plate 334 resumes its lower position.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector for a flexible printed circuit, comprising:

an insulative housing comprising a receiving slot and a plurality of receiving passageways communicating with the receiving slot;

a plurality of terminals received in the receiving passageways;

a stuffer received in the receiving slot of the housing and comprising an elongate body and an elongate flange downwardly projecting from a rear edge of the body, the body defining a cutout in the rear edge thereof; and a metal shield enclosing the housing and comprising a top wall, a bottom wall opposite to the top wall, a pressing plate positioned between and parallel to the top and bottom walls, and a linker, the pressing plate and the bottom wall defining a receiving slot for receiving the stuffer, the linker comprising a link plate connecting the pressing plate and the bottom wall and a block plate extending laterally from a side edge of the link plate, the block plate supporting the body of the stuffer and preventing the stuffer from swaying upwardly and downwardly after the stuffer is pulled out from the housing; wherein the elongate body has a space left by the flange for engaging with the block plate.

2. The electrical connector as described in claim 1, wherein the distance between the block plate of the linker and the top wall is equal to the height of the body of the stuffer.

3. The electrical connector as described in claim 1, wherein the block plate extends perpendicularly from the side edge of the link plate to an adjacent side wall of the shield.

4. The electrical connector as described in claim 1, wherein the pressing plate and the top wall defines a receiving slot adapted for receiving the flexible printed circuit.

* * * * *